US010443814B2

(12) United States Patent
Zhang et al.

(10) Patent No.: US 10,443,814 B2
(45) Date of Patent: Oct. 15, 2019

(54) DIFFUSER WITH UPLIGHT

(71) Applicant: Dialight Corporation, Farmingdale, NJ (US)

(72) Inventors: Yinan Zhang, Long Branch, NJ (US); Sam Acacia, Staten Island, NY (US); Chakrakodi Vishnu Shastry, Princeton, NJ (US)

(73) Assignee: Dialight Corporation, Farmingdale, NJ (US)

( * ) Notice: Subject to any disclaimer, the term of this patent is extended or adjusted under 35 U.S.C. 154(b) by 0 days.

(21) Appl. No.: 15/715,406

(22) Filed: Sep. 26, 2017

(65) Prior Publication Data

US 2019/0093857 A1 Mar. 28, 2019

(51) Int. Cl.

| | |
|---|---|
| ***F21V 7/00*** | (2006.01) |
| ***F21V 3/04*** | (2018.01) |
| ***F21V 17/06*** | (2006.01) |
| ***F21V 13/04*** | (2006.01) |
| ***F21S 8/04*** | (2006.01) |
| ***F21Y 115/10*** | (2016.01) |

(52) U.S. Cl.

CPC ..... *F21V 7/0016* (2013.01); *F21S 8/043* (2013.01); *F21V 3/049* (2013.01); *F21V 13/04* (2013.01); *F21V 17/06* (2013.01); *F21V 7/0091* (2013.01); *F21Y 2115/10* (2016.08)

(58) Field of Classification Search

CPC ..... F21V 3/0615; F21V 3/0625; F21V 5/002; F21V 7/0016; F21V 13/04; F21V 17/06; F21S 8/043

See application file for complete search history.

(56) References Cited

U.S. PATENT DOCUMENTS 1,612,300 A * 12/1926 Manookin ..... F21V 7/04 362/303
1,992,196 A * 2/1935 Dauman ..... F21S 8/06 362/305
2,675,466 A * 4/1954 Baker ..... F21V 7/0016 362/308
4,186,433 A * 1/1980 Baldwin ..... F21S 8/04 362/263

(Continued)

FOREIGN PATENT DOCUMENTS

DE 10300885 A1 * 7/2004 ..... F21S 8/06

OTHER PUBLICATIONS

International Search Report and Written Opinion of corresponding PCT Application No. PCT/US18/52593, dated Dec. 20, 2018, 11 pages.

*Primary Examiner* — Alexander K Garlen

(57) ABSTRACT

The present disclosure is directed to an apparatus. The apparatus includes a light diffusion portion comprising a same shape and approximately a same two dimensional size as a bottom surface of a light source, a light redirection device coupled to a perimeter of the light diffusion portion, wherein the light redirection device redirects a first portion of light emitted from a light source in a direction opposite a second portion of light emitted from the light source that travels through the light diffusion portion, and at least one mechanical coupling member coupled to the light redirection device, wherein the at least one mechanical coupling member is to connect to a corresponding portion of the light source.

19 Claims, 5 Drawing Sheets

(56) References Cited

U.S. PATENT DOCUMENTS

| | | | | |
|---|---|---|---|---|
| 6,286,979 | B1 * | 9/2001 | Ramer | F21S 8/04 362/297 |
| 7,753,550 | B2 * | 7/2010 | Engel | F21V 7/0016 362/147 |
| 8,944,627 | B1 | 2/2015 | Hetrick | |
| 9,551,463 | B2 | 1/2017 | Barnetson et al. | |
| 9,684,115 | B1 | 6/2017 | Carney et al. | |
| 2014/0268816 | A1 * | 9/2014 | Ricci | F21S 8/063 362/311.13 |
| 2016/0097511 | A1 * | 4/2016 | Catalano | F21V 7/048 362/223 |
| 2016/0320019 | A1 | 11/2016 | Gibbs et al. | |
| 2017/0016597 | A1 * | 1/2017 | Engelen | F21K 9/61 |
| 2017/0159907 | A1 * | 6/2017 | Dyson | F21V 11/186 |

* cited by examiner

DIFFUSER WITH UPLIGHT

BACKGROUND

Traditional based lighting, such as metal halide technology, provides light output generally in a spherical pattern in all directions. The traditional lighting can provide a glowing "orb" appearance that is not too harsh on the eyes and provides light in all directions.

Over the last few years, light emitting diode (LED) based lighting has become more ubiquitous for providing light in large factories. There are many advantages to using LED based lighting, such as improved efficiency, reliability, and the like. The LED lights, however, are point source lights and may emit light in a more focused direction. In addition, the LED lights may have a different appearance. For example, the LED lights may have a brighter light output than the traditional lighting that may be harsher on the eyes and appear more pixelated than the traditional lights.

In certain applications, the LED based lighting may not provide enough up light for large factories. The result may be a "cave effect" in the factory where an upper portion of the factory may appear dark. The LEDs also may not provide enough light to light cat walks and other areas that are located above the lighting.

SUMMARY

In one embodiment, the present disclosure provides an apparatus. In one embodiment, the apparatus comprises a light diffusion portion comprising a same shape and approximately a same two dimensional size as a bottom surface of a light source, a light redirection device coupled to a perimeter of the light diffusion portion, wherein the light redirection device redirects a first portion of light emitted from a light source in a direction opposite a second portion of light emitted from the light source that travels through the light diffusion portion, and at least one mechanical coupling member coupled to the light redirection device, wherein the at least one mechanical coupling member is to connect to a corresponding portion of the light source.

In another embodiment, the present disclosure provides a lighting apparatus. In one embodiment, the lighting apparatus comprises a light fixture comprising a plurality of light emitting diodes (LEDs), wherein the plurality of light emitting diodes emit light in a first direction and a diffuser with uplight apparatus removably coupled to the light fixture. The diffuser with uplight apparatus comprises a light diffusion portion that has approximately a same shape and a same two dimensional size as a bottom surface of the light fixture, a reflector coupled to a perimeter of the light diffusion portion, wherein the reflector redirects a first portion of the light in a second direction opposite the first direction, and at least one mechanical coupling member coupled to the reflector, wherein the at least one mechanical coupling member is to connect to a corresponding portion of the light fixture.

The present disclosure provides another embodiment of an apparatus. The apparatus comprises a light diffusion portion, a reflector coupled at an angle around a perimeter of the light diffusion portion, wherein the reflector redirects light above a plane of light emitting diodes of a light source that emit the light, and at least one mechanical coupling member coupled to the reflector, wherein the at least one mechanical coupling member is to connect to a corresponding portion of the light source.

BRIEF DESCRIPTION OF THE DRAWINGS

The teaching of the present disclosure can be readily understood by considering the following detailed description in conjunction with the accompanying drawings, in which.

To facilitate understanding, identical reference numerals have been used, where possible, to designate identical elements that are common to the figures.

DETAILED DESCRIPTION

As discussed above, LEDs provide many advantages over traditional based light sources. However, LEDs are point source lights and may emit light in a more focused direction. As a result, LEDs may provide an insufficient amount of uplight in factories causing a "cave effect" and appear more pixelated when viewed from below.

Embodiments of the present disclosure provide a diffuser with uplight apparatus that can be removably attached to existing light fixtures. The diffuser with uplight apparatus provides a light weight and efficient solution to existing light fixtures that allow the existing light fixtures to provide additional uplight. In addition, the diffuser with uplight apparatus may provide diffusion of light that is emitted downward towards, e.g., a factory floor to provide a more even and less pixelated light.

The design of the diffuser with uplight apparatus possesses additional features that improve air flow to prevent over heating of the LEDs in the lighting fixture, prevent moisture and debris from collecting inside of the diffuser with uplight apparatus, and add safety for secondary couplings to the light fixture. In addition, the features allow additional accessories (e.g., netting) to be added to prevent animals from nesting inside of the apparatus when the lighting fixtures are located outside.

The design of the diffuser also provides a low profile such that a minimal amount of clearance is consumed by the addition of the diffuser with uplight apparatus. For example, some lighting fixtures in factories may be in areas that require a certain amount of clearance. The diffuser with uplight apparatus of the present disclosure provides a design that is low profile, while providing sufficient light diffusion and uplighting.

Figure 1:
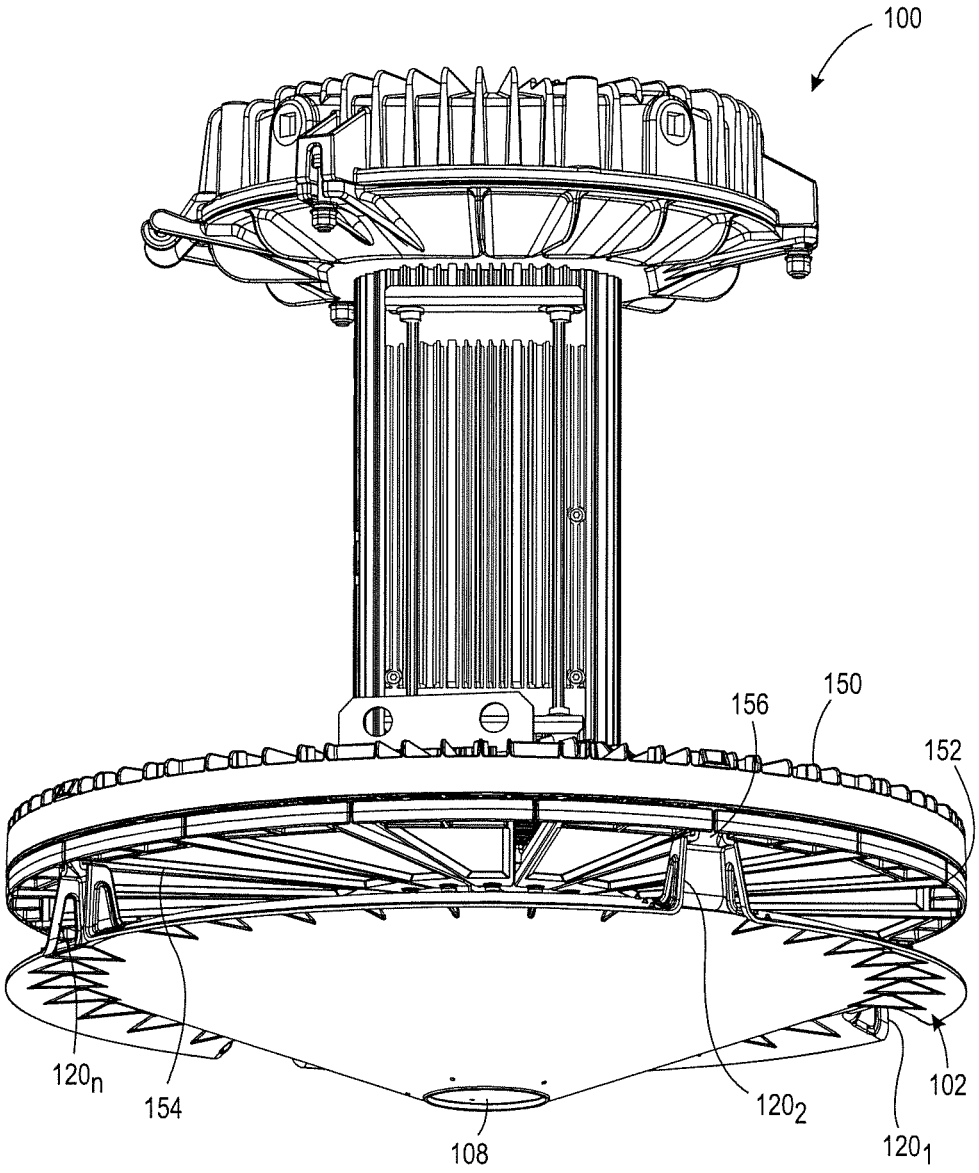
FIG. 1 depicts an isometric view of an example light fixture of the present disclosure.

FIG. 1 illustrates an example light apparatus 100 that includes a light fixture 150 and a diffuser with uplight apparatus 102 (also referred to herein as apparatus 102). In one embodiment, the light fixture 150 may be any type of light source that includes a plurality of light emitting diodes (LEDs) 152 that emit light.

In one embodiment, the apparatus 102 may include one or more mechanical coupling members $\mathbf{120}_1$ to $\mathbf{120}_n$ (hereinafter also referred to individually as a mechanical coupling member 120 or collectively as mechanical coupling members 120). The mechanical coupling member 120 may be any type of coupling mechanism such as a snap clip, spring clip, an interlocking member, a bolt, a magnetic clip, and the like.

The apparatus 102 may be coupled to a bottom surface 154 of the light fixture 150 via the mechanical coupling members 120. For example, each mechanical coupling member 120 may be coupled to a corresponding portion 156 of the light source located on the bottom surface 154 of the light fixture 150. In one embodiment, a damper (not shown) may be coupled between the mechanical coupling member 120 and the corresponding portion 156. The damper may be a foam material or any other types of shock absorbing material. The damper may allow the apparatus 102 to expand and contract with changing temperatures and absorb vibrations away from the light fixture 150.

In one embodiment, the corresponding portion 156 may be an opening that receives the mechanical coupling member 120. For example, the opening may have a portion to receive the snap clip, a threaded opening to receive a screw or bolt, a female member to receive a male member of an interlocking connector, and the like. In one embodiment, the bottom surface 154 may be defined as a surface of the light fixture 150 that is pointed downward, e.g., towards the ground, or floor, of a building.

As discussed in further detail below, the apparatus 102 includes portions that diffuse light emitted by the LEDs 152 evenly towards the ground and also reflect light emitted by the LEDs 152 upwards. The apparatus 102 may have a shape that is substantially similar to the shape of the light fixture 150. For example, the shape may refer to the shape of the outer perimeter of the apparatus 102 and the light fixture 150. For example, in FIG. 1, the shape of the perimeter of the bottom surface 154 of the light fixture 150 may be circular and the shape of the perimeter of the apparatus 102 may also be circular. However, it should be noted that the apparatus 102 and the light fixture 150 may have any same corresponding shape such as a square, a rectangle, a polygon, and the like.

In addition, the dimensions of the bottom surface 154 of the light fixture 150 and the dimensions of the apparatus 102 may be substantially similar. For example, the dimensions may refer to a two dimensional size. For example, the two dimensional size may be one or more diameters when the shape is circular, or length and width when the shape is a polygon.

In one embodiment, the apparatus 102 may include an opening 108 in approximately a center of the apparatus 102. The opening 108, as discussed in further detail below, may be sized to allow the apparatus 102 to perform proper light diffusion, but also allow moisture and debris to fall through without collecting inside of the apparatus 102. The opening 108 also allows cool air to be taken into the stagnant region between the diffusion portion (discussed below) and the LEDs 152. The opening 108 may be a circular opening, a plurality of small perforations, one or more slots, and the like.

Figure 2:
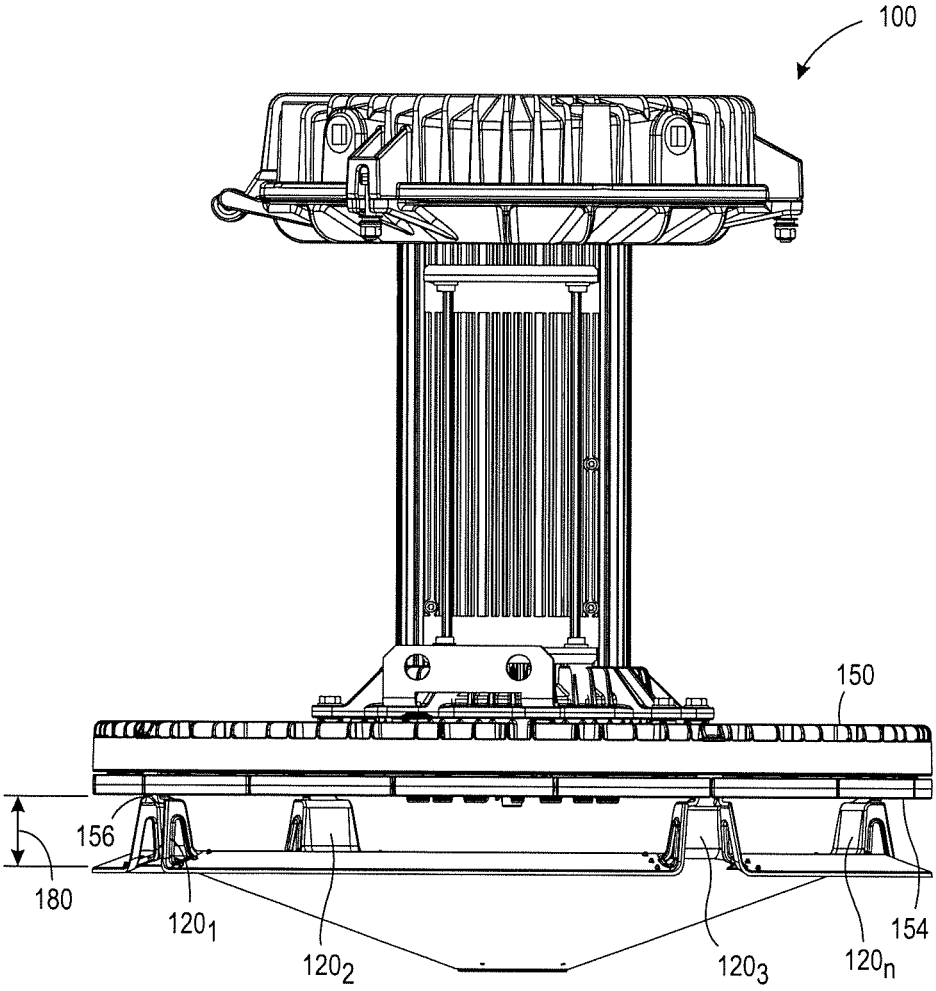
FIG. 2 depicts a side view of the example light fixture of the present disclosure.

FIG. 2 illustrates a side view of the example light apparatus 100. In one embodiment the mechanical coupling members 120 may be sized to create a gap 180 between the bottom surface 154 of the light fixture 150 and the apparatus 102. In one embodiment, the air gap 180 may be sized based on a diameter or length and width of the bottom surface 154 of the light fixture 150. Using the circular shape illustrated in FIG. 1, the air gap 180 may be 0.02 to 0.10 of the diameter. For example, if the diameter were 24 inches, the air gap may be approximately 0.48 inches to 2.4 inches. The air gap 180 may be measured from a bottom surface 154 of the light fixture 150 to a top surface of the apparatus 102.

The air gap 180 allows air to flow through and prevent over heating of the LEDs 152, unlike traditional diffusers that are mounted flush to the bottom of a light fixture. The opening 108 and the air gap 180 provide a path for air to flow through between the light fixture 150 and the apparatus 102.

Figure 3:
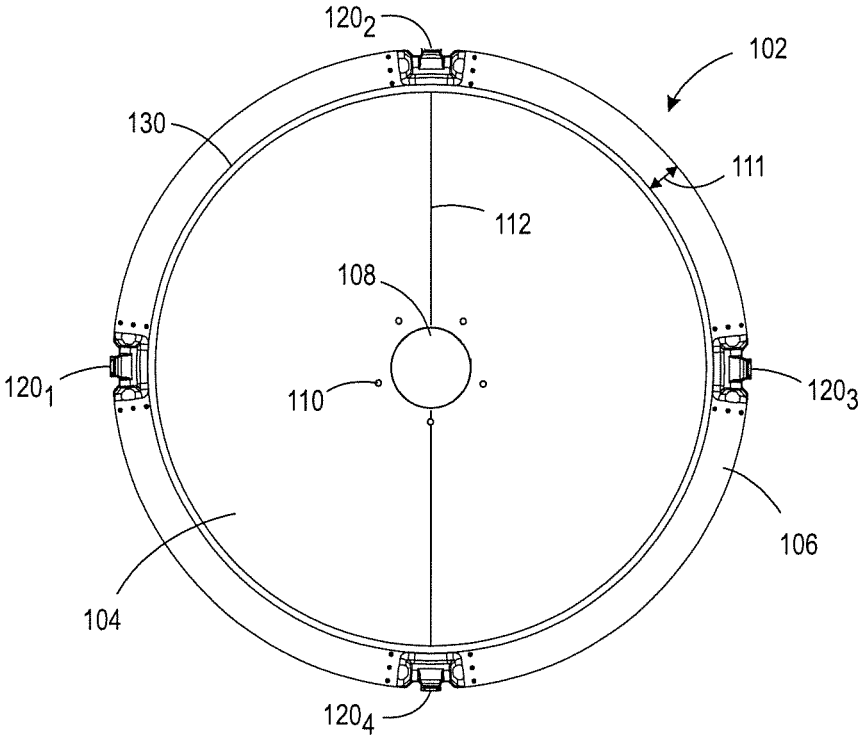
FIG. 3 depicts a top view of an example diffuser with uplight apparatus of the present disclosure.
Figure 4:
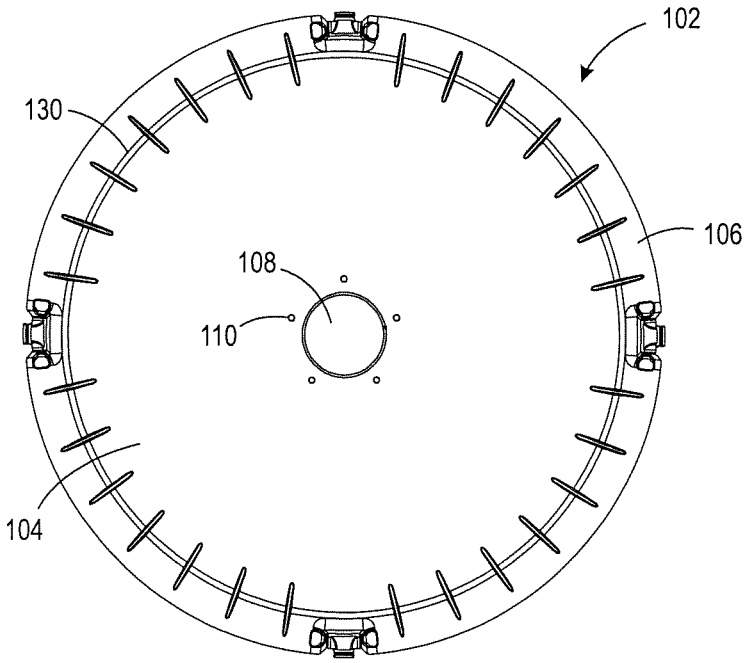
FIG. 4 depicts a bottom view of the example diffuser with uplight apparatus of the present disclosure.

FIG. 3 illustrates a detailed top view of the apparatus 102 and FIG. 4 illustrates a detailed bottom view of the apparatus 102. In one embodiment, the apparatus 102 may include a light diffusion portion 104 and a light redirection device 106. The light diffusion portion 104 and the light redirection device 106 may share a common interface 130. The common interface 130 may form an angle between the light diffusion portion 104 and the light redirection device 106, as discussed in further detail below.

In one embodiment, the light redirection device 106 may be a reflector, a reflective coating, a total internal reflection surface, a light pipe or waveguide, and the like. The surface of the light redirection device 106 may be flat or have a curved surface (e.g., convex or concave).

In one embodiment, the light diffusion portion 104 and the light redirection device 106 may be a plastic or a glass material. The light diffusion portion 104 and the light redirection device 106 may be fabricated or molded as a single continuous piece or may be coupled together as different pieces during manufacturing. In one embodiment, the light redirection device 106 may be coupled to the entire perimeter of the light diffusion portion 104. In other words, the light direction device 106 may be formed or coupled to completely surround the light diffusion portion 104.

In one embodiment, the light diffusion portion 104 may be the portion that has approximately the same shape as the bottom surface 154 of the light fixture 150, as described above. The light diffusion portion 104 may have approximately a same two dimensional size as the bottom surface 154 of the light fixture 150. The two dimensional size may be a diameter 112 as illustrated in FIG. 3. As noted above, for polygon shapes the two dimensional size may be a length and a width of the light diffusion portion 104.

In one embodiment, the mechanical coupling members 120 may be located around a perimeter of the apparatus 102 on the light redirection device 106. The mechanical coupling members 120 may be placed evenly around the light redirection device 106 in a symmetric fashion.

As noted above, the apparatus 102 may include the opening 108. The size of the opening 108 may be a function of the diameter 112 of the light diffusion portion 104. In one embodiment, the diameter of the opening 108 may be approximately 0.01 to 0.05 of the diameter 112. For example, if the diameter 112 of the light diffusion portion 104 were 24 inches, the opening 108 may have a diameter of approximately 0.24 inches to 1.2 inches.

In one embodiment, the apparatus 102 may include one or more functional openings 110 around the opening 108. The functional openings 110 may be optional. The functional openings 110 may provide openings to allow a net, or any other components, to be coupled to the light diffusion portion 104 and cover the opening 108. The net may allow air to pass through, while preventing animals from nesting inside of the apparatus 102. In another embodiment, the opening 108 may be formed as a vented grid with many openings, a series of perforations, one or more narrow slots, and the like as discussed above, that are small enough to prevent animals from nesting inside of the apparatus 102, without the need for the functional openings 110.

In one embodiment, a width 111 of the light redirection device 106 may be approximately a function of the diameter 112 of the light diffusion portion 104. In one embodiment, the width 111 of the light redirection device 106 may be approximately 0.05 to 0.10 of the diameter 112. For example, if the diameter 112 of the light diffusion portion 104 were 24 inches, the width 111 of the light redirection device 106 may be approximately 1.2 inches to 2.4 inches.

Figure 5:
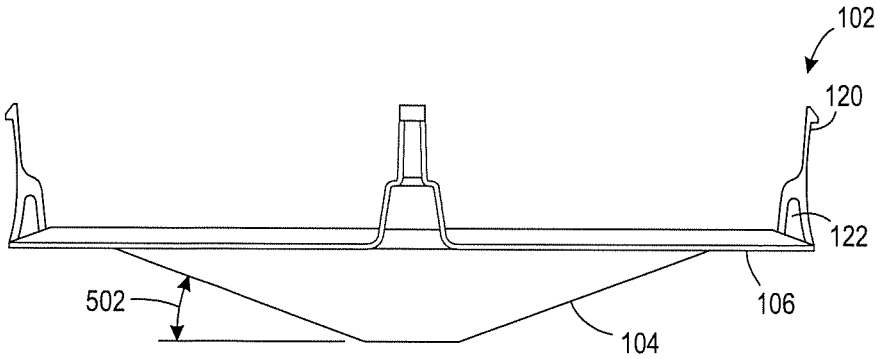
FIG. 5 depicts a side view of the example diffuser with uplight apparatus of the present disclosure.

FIG. 5 illustrates a detailed side view of the apparatus 102. In one embodiment, the mechanical coupling member 120 may have a functional opening 122. The functional opening 122 may be formed completely through the mechanical coupling member 120 as shown in FIG. 5. The functional opening 122 may allow additional components to be added to the light apparatus 100. For example, the functional opening 122 may provide a passageway to allow a net to be coupled around the perimeter of the light apparatus between the light fixture 150 and the apparatus 102. The net may allow air to continue to flow, while preventing animals from nesting inside the apparatus 102. The functional opening 122 may also provide a passageway for a secondary coupling to the light fixture 150. For example, a wire or cable may be looped through the functional opening 122 of each mechanical coupling member 120 and coupled to the light fixture 150. As a result, if the mechanical coupling member 120 breaks or fails, the secondary coupling may ensure that the apparatus 102 does not fall to the ground and injure people below the light fixture 150.

FIG. 5 also illustrates the angled surface of the light diffusion portion 104. The light diffusion portion 104 may have a conic shape or angled shape that allows the light emitted from the LEDs 152 to be spread evenly towards the ground. For example, the light diffusion portion 104 may diffuse a portion of the light emitted from the LEDs 152 to reduce LED pixilation and glare. In one embodiment, the surface of the light diffusion portion 104 may be angled relative to a horizontal axis as shown by an angle 502. The angle may be approximately 0 degrees to 45 degrees.

In one embodiment, the surface of the light diffusion portion 104 may have texture or optical features to help spread the light emitted from the LEDs 152. For example, the texture or the optical features may include bumps, pyramid pieces, rings, lines, and the like. The texture or the optical features may be attached with an external film or be molded into the light diffusion portion 104. In one embodiment, the light diffusion portion 104 may have a concave or convex surface. In one embodiment, the texture or the optical features may cover the whole surface of the light diffusion portion 104 or a portion of the surface. The texture or the optical features may be located on an inside surface (e.g., the surface closest to the bottom surface 154 of the light fixture 150) or located on an outside surface (e.g., the surface opposite the inside surface or furthest away from the bottom surface 154 of the light fixture 150).

Figure 6:
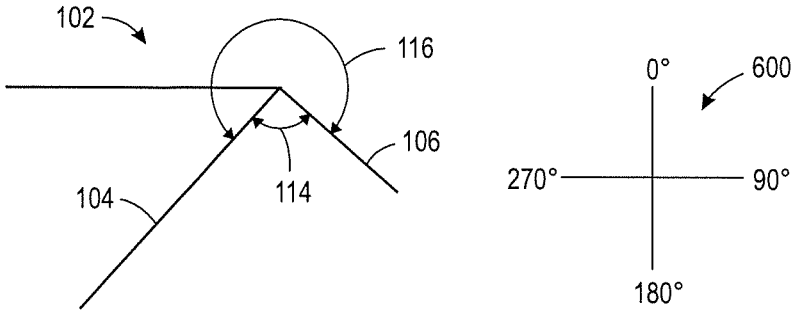
FIG. 6 depicts a cross-sectional side view of the example diffuser with uplight apparatus.

FIG. 6 illustrates a cross-sectional side view of the example apparatus 102. As illustrated in FIG. 6, in one embodiment, the light redirection device 106 may be angled relative to the light diffusion portion 104. FIG. 6 illustrates an axis 600 that illustrates a reference point for an angle 114, and 116. The axis 600 illustrates 360 degrees around.

In one embodiment, the light redirection device 106 and the light diffusion portion 104 may be coupled to form the angle 116 that is greater than 180 degrees. For example, a surface of the light diffusion portion 104 and the light redirection device 106 that is closest to the light fixture 150 may be coupled to form the angle 116. In one embodiment, the angle 116 may be approximately 230 degrees to 300 degrees relative to the axis 600.

Described in another way, a surface of the light redirection device 106 and the light diffusion portion 104 that is farthest away from the light fixture 150 may be coupled to form the angle 114. The angle 114 may be less than 180 degrees. In one embodiment, the angle 114 may be approximately 90 degrees to 120 degrees relative to the axis 600.

Figure 7:
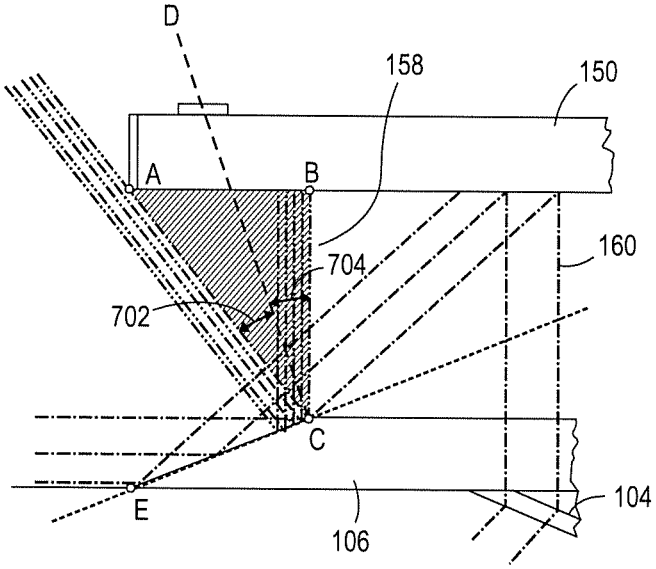
FIG. 7 depicts a side view of how light is redirected by the example diffuser with uplight apparatus.

FIG. 7 illustrates an example side view of how light emitted from the LEDs 152 is redirected by the apparatus 102. The position of the light redirection device 106 relative to a bottom surface 154 of the light fixture 150 may prevent uplight from being blocked by the light fixture 150. In addition, optimizing the angle of the light redirection device 106 may improve the efficiency of the light fixture 150.

As illustrated in FIG. 7 a first portion 158 of the light emitted from the light source (e.g., LEDs 152) may be redirected by the light redirection device 106. A second portion 160 of the light emitted from the light source (e.g., LEDs 152) may be redirected by the light diffusion portion 104.

In FIG. 7, a point A may represent an end outside diameter of the light fixture 150. A point B may represent an end outside diameter of the light emitting area. For example, a housing that encloses the LEDs 152 may have a wider diameter than the diameter of the LEDs 152 located inside of the housing.

A point C may represent an end of an inner diameter of the light redirecting device 106. For example, the point C may be an apex or point where the light redirecting device 106 and the light diffusion portion 104 meet.

A point E may represent an end of an outside diameter of the light redirecting device 106. A line CD may be drawn that represents an angular bisector through the point C. The angular bisector may create equal angles 702 and 704 in cone formed by points ABC, as shown in FIG. 7. The surface of the light redirecting device 106 represented by a line CE may be perpendicular to the line CD to provide an optimum angle with respect to a vertical axis (e.g., the vertical axis may be represented by a line drawn between C and B and the optimum angle may be the angle between the vertical axis and the bisector line represented by the line CD). In other words, the optimum angle may be defined as the angle formed between the line CD and the vertical axis CB, while the line CD is perpendicular to the line CE.

In one embodiment, to achieve optimum efficiency and maximize the uplight the angle of the surface CE with respect to the vertical axis (e.g., the line CB), the line CD, while remaining normal to the surface CE, may be moved within +/−15 degrees of the optimum angle. In other words, the lines CD and CE are moved together +/−15 degrees relative to the optimum angle, while keeping the line CD perpendicular to the line CE.

Figure 8:
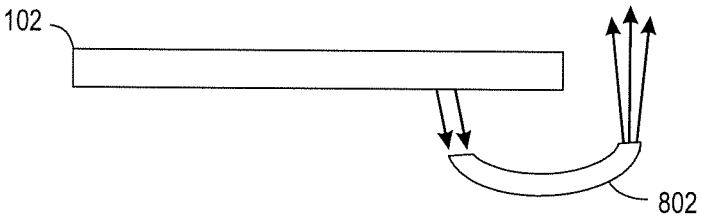
FIG. 8 depicts a side view of a second embodiment of the example diffuser with the uplight apparatus of the present disclosure.

FIG. 8 illustrates a side view of a second embodiment of the apparatus 102 that includes a light pipe or waveguide 802. In one embodiment, the light reflecting device 106 may be the light waveguide 802 that is coupled to the light diffusion portion 104. The light waveguide 802 may be positioned in any desired position or angle to redirect light above the plane of the LEDs 152.

While various embodiments have been described above, it should be understood that they have been presented by way of example only, and not limitation. Thus, the breadth and scope of a preferred embodiment should not be limited by any of the above-described exemplary embodiments, but should be defined only in accordance with the following claims and their equivalents.

What is claimed is:

1. An apparatus, comprising:

a light diffusion portion comprising a same shape and approximately a same two dimensional size as a bottom surface of a light source, wherein the bottom surface of the light source comprises an end outside diameter of a housing of the light source and an end outside diameter of the light source;

a light redirection device coupled to an entire perimeter of the light diffusion portion, wherein the light redirection device comprises an apex where the light redirection device and the light diffusion portion meet, wherein the light redirection device is coupled to the light diffusion portion such that a surface of the light redirection device is perpendicular to an angular bisector that runs through the apex and a point between the end outside diameter of the housing of the light source and an end outside diameter of the light source, wherein the angular bisector creates equal angles between the apex and a first line that runs through the apex and the end outside diameter of the housing of the light source and the apex, and a second line that runs through the apex and the end outside diameter of the light source, wherein the light redirection device redirects a first portion of light emitted from the light source in a direction opposite a second portion of light emitted from the light source that travels through the light diffusion portion; and at least one mechanical coupling member coupled to the light redirection device, wherein the at least one mechanical coupling member is to connect to a corresponding portion of the light source.

2. The apparatus of claim 1, wherein the light diffusion portion, the light redirection device and the at least one mechanical coupling are molded as a single piece.

3. The apparatus of claim 1, wherein a surface of the light diffusion portion and a surface of the light redirection device that are closest to the light source are coupled to form an angle that is greater than 180 degrees.

4. The apparatus of claim 1, wherein the light redirection device comprises a reflector.

5. The apparatus of claim 1, wherein the light redirection device comprises a light waveguide.

6. The apparatus of claim 1, wherein the light diffusion portion comprises an angled surface.

7. The apparatus of claim 1, wherein the light diffusion portion comprises at least one opening in approximately a center of the light diffusion portion.

8. The apparatus of claim 1, wherein the at least one mechanical coupling member is coupled to the light redirection device to form an air gap between the apparatus and a light emitting surface of the light source.

9. The apparatus of claim 1, wherein the at least one mechanical coupling member comprises a functional opening to provide a passageway for a secondary coupling.

10. A lighting apparatus, comprising:

a light fixture comprising a plurality of light emitting diodes (LEDs), wherein the plurality of light emitting diodes emit light in a first direction; and a diffuser with uplight apparatus removably coupled to the light fixture, the diffuser with uplight apparatus, comprising:

a light diffusion portion that has approximately a same shape and a same two dimensional size as a bottom surface of the light fixture, wherein the bottom surface of the light fixture comprises an end outside diameter of the light fixture and an end outside diameter of the plurality of LEDs;

a reflector coupled to an entire perimeter of the light diffusion portion, wherein the reflector comprises an apex where the reflector and the light diffusion portion meet, wherein the reflector is coupled to the light diffusion portion such that a surface of the reflector is perpendicular to an angular bisector that runs through the apex and a point between the end outside diameter of the light fixture and an end outside diameter of the plurality of LEDs, wherein the angular bisector creates equal angles between the apex and a first line that runs through the apex and the end outside diameter of the light fixture, and the apex and a second line that runs through the apex and the end outside diameter of the plurality of LEDs, wherein the reflector redirects a first portion of the light in a second direction opposite the first direction; and at least one mechanical coupling member coupled to the reflector, wherein the at least one mechanical coupling member is to connect to a corresponding portion of the light fixture.

11. The lighting apparatus of claim 10, wherein the light diffusion portion has a shape that is substantially similar to a shape of the light fixture.

12. The lighting apparatus of claim 10, wherein a surface of the light diffusion portion and a surface of the reflector that are closest to the light source are coupled to form an angle that is greater than 180 degrees.

13. The lighting apparatus of claim 10, wherein the at least one mechanical coupling member is coupled to the light fixture to form an air gap between the light diffusion portion and a bottom surface of the light fixture.

14. The lighting apparatus of claim 10, wherein the at least one mechanical coupling member comprises a functional opening to provide a passageway for a secondary coupling to the light fixture.

15. An apparatus, comprising:

a light diffusion portion;

a reflector coupled at an angle around an entire perimeter of the light diffusion portion, wherein the reflector redirects a light above a plane of light emitting diodes of a light source that emit the light, wherein a bottom surface of the light source comprises an end outside diameter of a housing of the light source and an end outside diameter of the light emitting diodes of the light source, wherein the reflector comprises an apex where the reflector and the light diffusion portion meet, wherein the reflector is coupled to the light diffusion portion such that a surface of the reflector is perpendicular to an angular bisector that runs through the apex and a point between the end outside diameter of the housing of the light source and an end outside diameter of the light emitting diodes of the light, wherein the angular bisector creates equal angles between the apex and a first line that runs through the apex and the end outside diameter of the housing of the light source and the apex, and a second line that runs through the apex and the end outside diameter of the light emitting diodes of the light source; and at least one mechanical coupling member coupled to the reflector, wherein the at least one mechanical coupling member is to connect to a corresponding portion of the light source.

16. The apparatus of claim 15, wherein the reflector has a width of approximately 0.05 to 0.10 of a diameter of the light diffusion portion.

17. The apparatus of claim 15, wherein the angle comprises approximately 90 degrees to 120 degrees.

18. The apparatus of claim 15, wherein the light diffusion portion comprises at least one opening and at least one functional opening around the at least one opening in approximately a center of the light diffusion portion.

19. The apparatus of claim 15, wherein the at least one mechanical coupling member comprises a snap clip having a functional opening to provide a passageway for a secondary coupling.

* * * * *